United States Patent [19]

Maynard

[11] 4,252,494

[45] Feb. 24, 1981

[54] APPARATUS FOR SUPPORTING A CONDITIONING TOOL WITHIN A FURNACE

[75] Inventor: James J. Maynard, Marcellus, N.Y.

[73] Assignee: Syracuse Supply Company, Syracuse, N.Y.

[21] Appl. No.: 32,368

[22] Filed: Apr. 23, 1979

[51] Int. Cl.[3] ..... C21B 7/14

[52] U.S. Cl. ..... 414/587; 432/235

[58] Field of Search ..... 414/214, 215, 198, 586, 414/587, 718, 719, 720, 722, 727, 688, 696; 62/DIG. 10; 266/228, 287; 432/233, 235

[56] References Cited

U.S. PATENT DOCUMENTS

| | | | |
|---|---|---|---|
| 2,078,640 | 4/1937 | Segar | 414/198 X |
| 2,198,649 | 4/1940 | Adas | 266/287 |
| 3,169,910 | 2/1965 | Hummel | 414/198 X |
| 3,784,034 | 1/1974 | Thompson | 414/587 X |
| 3,800,965 | 4/1974 | Barron et al. | 414/787 |
| 3,931,898 | 1/1976 | Konstantinovich et al. | 414/587 |
| 3,964,977 | 6/1976 | Haase | 414/587 X |
| 4,158,541 | 6/1979 | Klechka | 432/235 X |

*Primary Examiner*—James L. Rowland
*Attorney, Agent, or Firm*—Bruns & Jenney

[57] ABSTRACT

An elongated boom for supporting a tool for conditioning metal or the like within a high temperature furnace. The boom has internal passageway for directing cooling air therethrough so as to reduce the potentially dangerous effects of high temperatures upon the thermally exposed sections of the boom. The boom is supported at one end in a carriage that is arranged to move back and forth within a horizontally aligned gantry to enable a conditioning tool supported in the opposite end of the boom to be readily moved in and out of the furnace. A blower for pumping ambient air into the boom is mounted directly upon the carriage adjacent to the boom eliminating the need for extensive air handling hoses and the like.

13 Claims, 5 Drawing Figures

APPARATUS FOR SUPPORTING A CONDITIONING TOOL WITHIN A FURNACE

BACKGROUND OF THE INVENTION

This invention relates to an improved boom assembly for supporting a tool for conditioning metals and the like within a high temperature furnace.

Many of the newer furnaces now being introduced for use in reclaiming metals from scrap material utilize relatively large melting beds. Typically the scrap material is randomly deposited in the melting bed where it is exposed to very high melting temperatures. As the material begins to melt, it is very important to more evenly distribute the materials in the bed in order to provide for a more efficient operation. Once melted, any slag that might have formed on the surface of the liquid is skimmed off prior to pouring the metal from the furnace. A single rake-like tool, which is herein referred to as a conditioning tool, is usually employed to carry out both the skimming and material handling functions.

As best illustrated in U.S. Pat. Nos. 943,591, 3,800,965 and 3,931,898, extendable boom assemblies for supporting conditioning tools have been used for quite some time in the art. Typically, the boom is telescoped within some type of horizontally aligned support structure and is adapted to be run out from the support to increase the reach of the conditioning equipment. There is, however, no provision made in any of the prior art devices for cooling either the boom or the tool contained therein. As a consequence, the usable life of the equipment in a high temperature environment must be relatively short. It is further believed that without some form of cooling, the unsupported end of a boom of any considerable length will in a short period of time warp or sag when exposed to high furnace temperatures whereupon the boom might become lodged in the furnace and thus difficult to remove without damaging the furnace structure.

Hand-held tools, as typically used to skim slag from small melting furnaces, are sometimes furnished with cooling means to protect both the user and the equipment from becoming overheated. As evidenced in the disclosure in U.S. Pat. Nos. 1,827,504 and 2,198,649, a water jacket is generally formed inside the handle and/or blade of the skimmer and cooling water from a remote source is pumped therethrough to furnish the desired cooling. An extensive amount of hose is needed to supply water to the apparatus, particularly where it is used to service more than one furnace. This hose presents a problem in that it can be severed easily and has a way of becoming fouled in other equipment. Similarly, the use of water as a coolant considerably increases the weight of the equipment and, in the case of an elongated boom or the like, would be prohibitive. Furthermore, the use of water as a coolant is generally limited to low temperature applications. When water is exposed to very high temperatures it can quickly flash to steam, thereby giving rise to all the well-known problems associated with handling this relatively dangerous substance.

SUMMARY OF THE INVENTION

It is therefore an object of the present invention to improve equipment for supporting and manipulating a conditioning tool within a high temperature furnace.

Another object of the present invention is to provide an air-cooled boom of considerable length for supporting a conditioning tool so that it can be safely and effectively moved into and out of a high temperature furnace.

Yet another object of the present invention is to provide a relatively lightweight boom for supporting a conditioning tool that is of considerable length and which will not be thermally damaged when exposed to high furnace temperatures.

A further object of the present invention is to extend the usable life of equipment used to condition materials in high temperature furnaces.

These and other objects of the present invention are attained by means of an elongated boom that is adapted to support a conditioning tool in one end thereof and which is supported at the opposite end in a carriage mounted upon rails within a horizontally aligned gantry whereby the tool is able to be moved into and out of a furnace. Internal air passages are provided in the boom for directing a flow of cooling air therethrough to cool the parts of the boom and the tool exposed to the high furnace temperatures. A blower is mounted upon the carriage and is arranged to pump ambient air through the air passages to furnish the necessary cooling.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
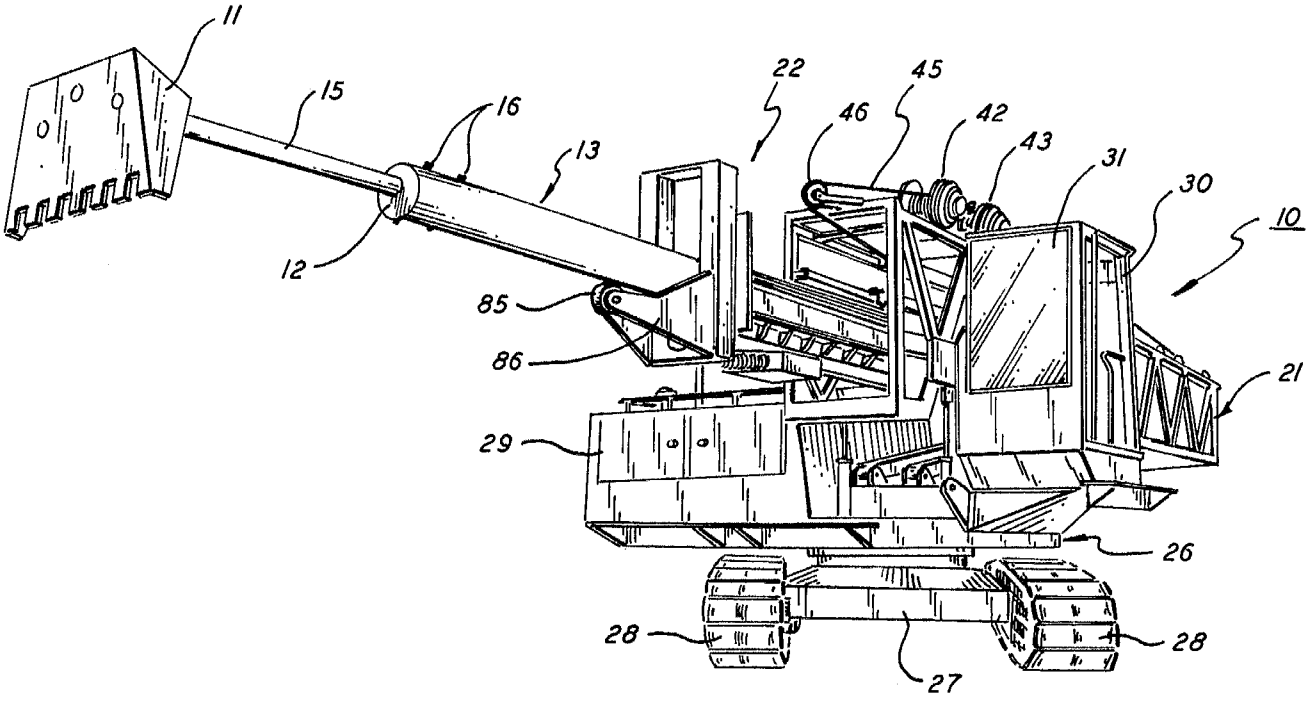
FIG. 1 is a perspective view of a mobile machine embodying the teachings of the present invention which includes an elongated air-cooled boom that is adapted to move a conditioning tool into and out of a high temperature furnace.
Figure 2:
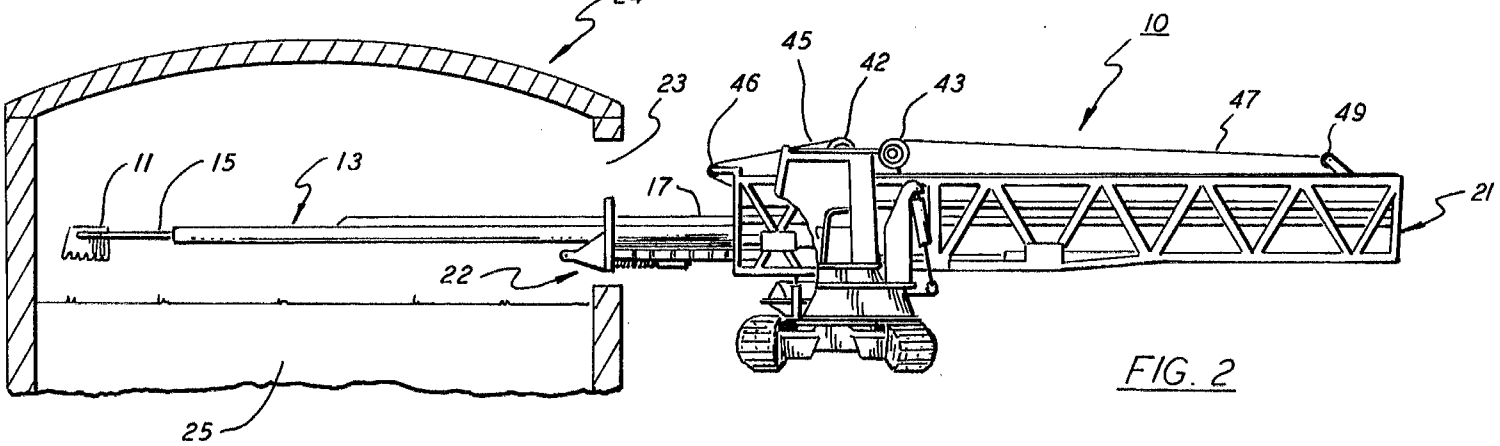
FIG. 2 is a side elevation of the machine shown in FIG. 1 further illustrating the boom being extended into a high temperature furnace for reclaiming scrap material.

Referring initially to FIGS. 1 and 2, there is illustrated apparatus generally referenced 10 embodying the teachings of the present invention. A conditioning tool 11 is shown secured in the front or distal end 12 of an elongated boom 13 by locking the handle 15 of the tool to the boom via suitable locking bolts 16—16 whereby the tool can be conveniently replaced in assembly. As will be explained in greater detail below, the back or proximal end 17 of the boom is supported within a carriage, generally indicated as 20 (FIG. 3) that is adapted to move back and forth within a horizontally aligned gantry 21 along a prescribed path of travel. The main body of the boom extends outwardly through the front of the gantry and rests within a cradle 22 that is also movably mounted within the gantry forward of the carriage. As best seen in FIG. 2 the boom can be extended outwardly from the gantry a considerable length whereby the tool may be passed through an access door 23 of a high temperature furnace 24 to condition materials contained in the furnace bed 25.

The gantry is adjustably supported upon a gear-driven turntable 26 that is arranged to turn in a generally horizontal plane through 360° of rotation on a chassis 27. The chassis is furnished with a pair of conventional endless treads 28—28 whereby the equipment can be freely propelled over the ground to more accurately position the tool within a furnace or to transport the equipment between work stations. The front end of the gantry is vertically aligned at about the forward edge of the turntable with the main body of the gantry extending back some distance from the rear edge thereof. A drive housing 29 is mounted upon the turntable to one side of the gantry which covers an internal combustion engine for providing power to the drive treads and a gear train (not shown) for powering the turntable. Also enclosed within the housing are one or more pumps for providing hydraulic fluid under pressure to various hydraulic components used to drive systems contained in the present apparatus. A cab 30 is also mounted upon the turntable adjacent to the drive housing which contains controls by which the operator can maneuver the conditioning tool. The cab is furnished with a forward-facing transparent heat shield 31 designed to protect the operator from high furnace temperatures while at the same time affording a substantially unimpeded view of the conditioning tool.

Figure 5:
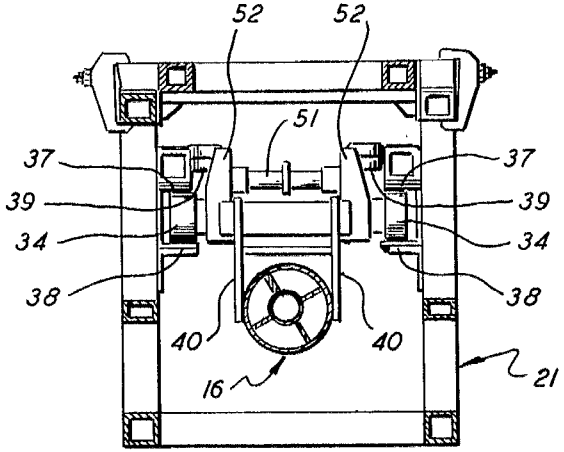
FIG. 5 is an elongated end view taken along lines 5—5 in FIG. 2 showing the carriage construction in greater detail.
Figure 3:
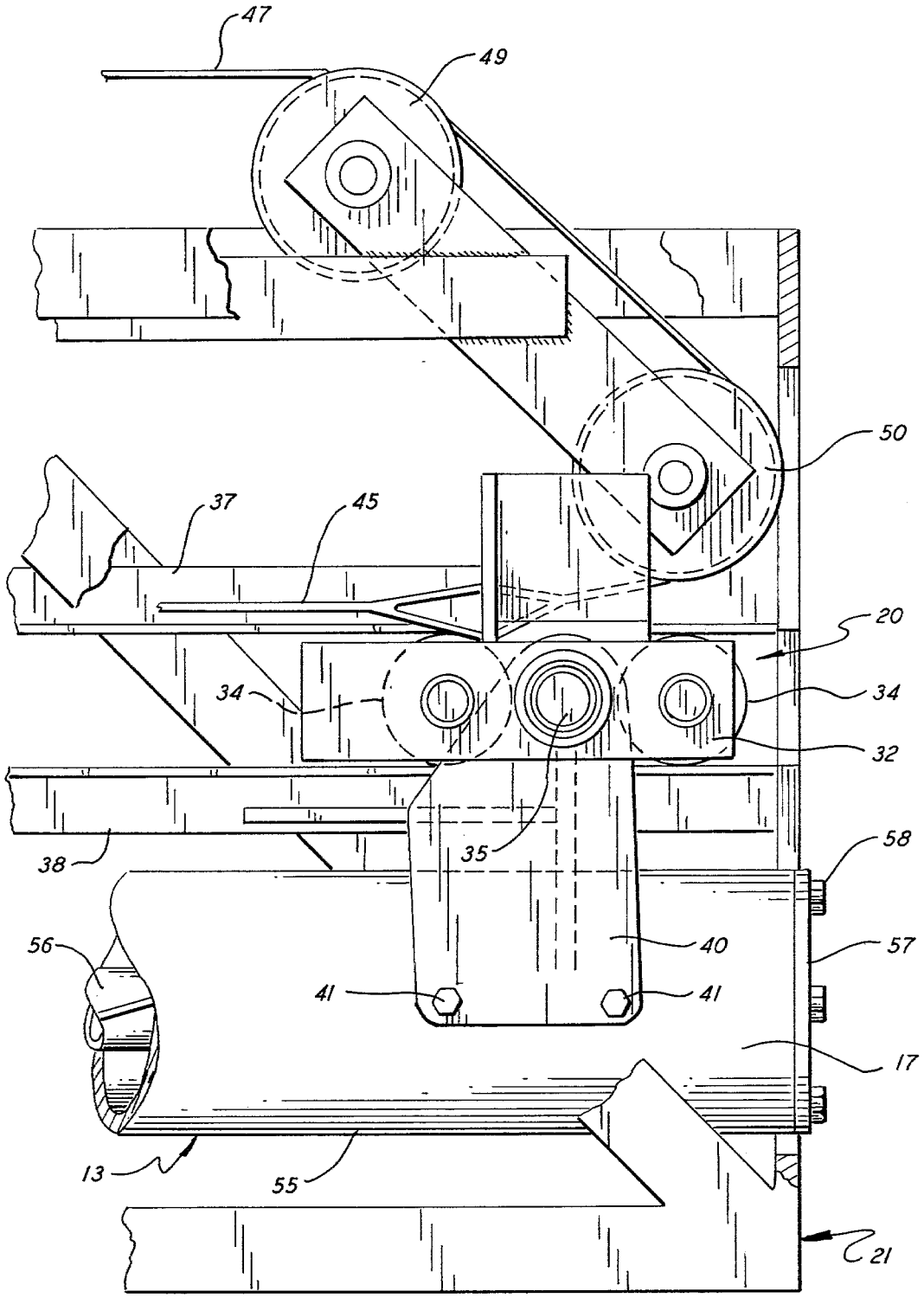
FIG. 3 is an enlarged side view showing the back end of the boom secured to a carriage that is arranged to move horizontally within a support gantry.
Figure 4:
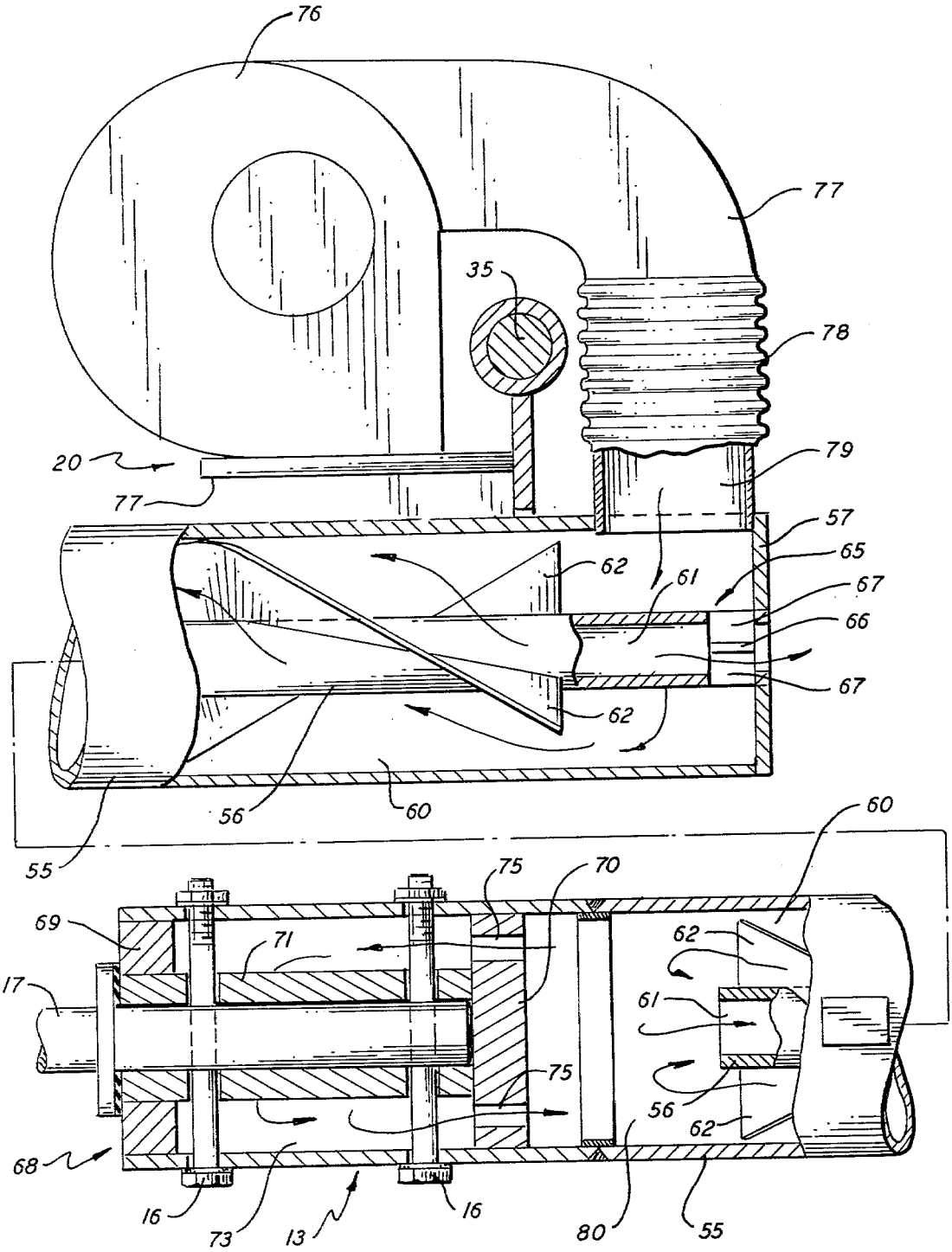
FIG. 4 is an enlarged side view with portions broken away showing the internal structure of the elongated boom.

The gantry 21 is fabricated from a plurality of structural elements that are brought together by welding and/or bolting to create a bridge-like section in which the boom is movably supported. With further reference to FIGS. 3-5, the boom is suspended beneath the carriage 20 which is adapted to ride along longitudinally extended rails secured to the sidewalls of the gantry. The carriage includes two opposed bogie plates 32—32 in which a pair of wheels 34—34 are journalled for rotation. A horizontal pivot 35 is secured in each bogie plate between the wheels which, among other things, helps to maintain lateral spacing between the wheel pairs. As best seen in FIG. 3, each wheel pair rides between an upper guide rail 37 and a lower guide rail 38. In practice, the rails may be formed of angle irons welded to the inside sidewalls of the gantry so as to present a horizontally turned leg to the carriage wheels. Side rollers 39, which are supported in the upper guide rails as shown in FIG. 5, prevent lateral displacement of the carriage within the gantry as it moves back and forth over its prescribed path of travel.

The boom is suspended below the carriage by means of side hangers 40—40 (FIG. 3) pivotably mounted upon the pivot and secured to the back end of the boom by means of bolts 41—41. Although not shown, suitable bearing means are provided to allow the boom to freely swing about the pivot in a generally vertical plane.

The carriage is moved back and forth over the rails by means of a pair of coacting hydraulically operated winches 42 and 43 (FIG. 1) mounted atop the gantry directly over the turntable. Forward winch 42 is connected to the carriage via a cable 45 that is brought around forward pulley 46 and passed rewardly through the open front of the gantry. Rear winch 43 is connected to the carriage by a second cable 47 arranged to pass over two cooperating rear pulleys 49 and 50 (FIG. 3) which direct the cable inwardly through the rear of the gantry. The ends of both cables are secured to a raised bar 51 that is mounted in the carriage above the pivot between two upraised elements 52—52. The winches are adapted to work in concert to pull the carriage, and thus the tool boom supported therebeneath, back and forth along the rails thus enabling the tool mounted in the distal end of the boom to be moved rapidly into and out of the furnace.

Boom 13 includes an elongated outer cylinder 55 in which is contained a smaller diameter inner cylinder 56. In assembly the length of the inner cylinder is slightly less than that of the outer cylinder. A rear wall 57 is secured, as for example by bolts 58, to the proximal end of the boom and contains a centrally located hole through which the back end of the inner cylinder is passed in airtight relationship therewith. In assembly, the two superimposed cylinders establish two individual air passages within the boom that are parallelly aligned along the axis of the boom. The passages include an outer passage 60 and an inner passage 61. A pair of radially extended fins 62—62 are spirally wrapped about the outside surface of the inner cylinder. The fins extend outwardly in a radial direction so that they span across the width of the outer passage 60. The fins serve to subdivide the outer passage into a plurality of helical-shaped flow channels. In practice, the fins may be welded to the inner cylinder and permitted to rest against the outer cylinder to help support the inner cylinder in coaxial alignment with the outer cylinder. A cruciform-shaped key 65 is used to prevent axial shifting of one cylinder in relation to the other. The key has a pair of horizontally extended legs 66 that are passed through the wall of the inner cylinder and are affixed as by welding to both the inner and outer cylinder walls to secure the two members together in assembly. A pair of short vertical legs 67—67 are further provided which are also affixed as by welding to the wall of the inner cylinder to add strength to the system and to further prevent moving or twisting of the cojoined members.

At the front or tool supporting end 12 of the boom there is provided a tool holder assembly that is generally referenced 68 (FIG. 4). The assembly includes a cylindrical front wall 69 and a companion cylindrical back wall 70 which are slidably received within the outer cylinder 55 of the boom. A sleeve 71 is passed inwardly through an opening provided in the front wall 69 and is abutted in perpendicular alignment against back wall 70. The assembled components are welded in place to support the sleeve in coaxial alignment within the boom. In practice, the handle 17 of the conditioning tool is slidably received within the sleeve so that it bottoms against the back wall 70. The locking bolts 16—16 are then passed through suitably aligned holes to secure the handle to both the sleeve 71 and the outer cylinder 55 of the boom. A cooling chamber 73 is provided between the sleeve and the outer cylinder wall which communicates with the interior of the boom by means of a number of air ports 75—75 formed in the rear wall of the tool holder.

Cooling air is pumped into the boom from a blower 76 that is secured to a base element 77 carried upon the boom carriage. The discharge duct 77 of the blower is connected directly into the rear end of the boom by means of a flexible connector 78 and an inlet pipe 79. The inlet pipe enters the outer air passage at the rear end of the boom as shown in FIG. 4. Under the influence of the blower, ambient cooling air is pumped into the outer passage 60 and forced along the spiral channels described by the vanes toward the front end of the boom. At the front end of the boom the cooling air enters a plenum 80 where the flow stream is turned and caused to return in the opposite direction through the inner passage 61 formed by the inner cylinder 56. The cooling air moves along the inner cylinder in counter flow relationship with the incoming stream and is finally exhausted to atmosphere through the rear wall 57 of the boom. A portion of the cooling air that enters the plenum is passed through air ports 75—75 formed in the back wall of the tool holder assembly and is allowed to circulate under natural flow conditions within the cooling chamber 73 to conductively cool both the tool and the tool holder.

The entire boom structure is rendered airtight by either securely welding the component parts in assembly or providing gaskets where necessary to prevent cooling air from inadvertently leaking from the structure. Sufficient quantities of air are moved through the boom to maintain the boom temperature well below a level at which the equipment will be damaged during the period it is exposed to the high furnace temperatures. The vanes mounted within the outer passage of the boom serve to prevent cooling air from becoming stagnated in localized areas and thus creating "hot spots." The spiral passageways also extend the amount of time that the cooling air remains in heat transfer relationship with the outer boom structure thereby increasing the efficiency of the cooling system.

As best seen in FIGS. 1 and 2, the front end of the boom is mounted with a cradle generally depicted as 22. A rest in the form of a forward roll 85 is mounted in a bifurcated arm 86 secured to the carriage. The roll is arranged to ride in rolling contact against the bottom of the boom to enable the boom to be run out and returned by the carriage. As noted, the cradle is also movably supported within the gantry so that the forward rest position can be altered to help balance the boom in assembly.

While this invention has been described with reference to the structure disclosed herein, it is not confined to the details set forth and this application is intended to cover any modifications or changes as may come within the scope of the following claims.

I claim:

1. Apparatus for supporting a conditioning tool within a high temperature furnace including in combination an elongated boom that is arranged to support a conditioning tool at the front end thereof and having an internal air passage formed therein for directing a flow of cooling air through said boom, means for extending and retracting the boom along a reciprocal path of travel whereby the boom can be passed into and out of said furnace, an air blower secured to the back end of said boom so that the blower moves with said boom as it reciprocates into and out of the furnace, and connecting means for placing the discharge duct of said blower in fluid flow communication with the air passage of the boom whereby a stream of cooling air is pumped through said passage.

2. The apparatus of claim 1 wherein the back end of the boom and said blower are mounted upon a carriage that is arranged to move reciprocally along a prescribed path of travel.

3. The apparatus of claim 2 wherein said air passage includes an outer entrance section through which cooling air pumped into the back of the boom is directed to the front of the boom and an inner exit section through which cooling air at the front of the boom is directed in counter flow relationship with the entering air and exhausted to atmosphere at the back of said boom.

4. The apparatus of claim 3 wherein the outer entrance section of the air passage contains spiral vanes for directing the entering air moving therethrough along a spiral path of travel.

5. Apparatus for supporting a conditioning tool within a high temperature furnace including a horizontally aligned gantry, a carriage movably supported upon rails mounted within the gantry for reciprocal movement along a prescribed path of travel within the gantry, an elongated boom having a conditioning tool secured in the front end thereof, said boom being positioned within the gantry and having the back end thereof secured to said carriage and the front end thereof extending outwardly from the gantry whereby the tool may be extended and retracted toward said gantry, said boom further including a first hollow outer section and a second hollow inner section that are mounted in superposition to establish inner and outer passages extending axially along the boom with the inner passage exhausting to atmosphere at the back of said boom, an air blower mounted for movement upon said carriage having a discharge connected into the outer boom passage at the back of the boom whereby cooling air is moved from the back of the outer passage to the front thereof and then exhausted to atmosphere through the back of said inner passage, and at least one vane means that is spirally wrapped about the outer surface of the inner section for directing cooling air along a spiral path of travel as it moves through the outer passage.

6. The apparatus of claim 5 that further includes a tool holder mounted within the front end of the boom having an opening for receiving the handle of a tool in close sliding relationship therein and having locking means for securing the tool to the boom.

7. The apparatus of claim 6 that further includes a chamber means surrounding the tool holder mounted within the front end of the boom, said chamber means being in fluid flow communication with said outer passage whereby at least a portion of the cooling air pumped into the boom is caused to pass about the tool holder.

8. The apparatus of claim 5 wherein the inner and outer sections of said boom are cylindrical members and further includes spacer means for supporting the two cylinders in coaxial alignment.

9. The apparatus of claim 8 wherein the back end of the boom is sealed by a back wall and said inner cylindrical member is arranged to pass through the back wall whereby the cooling air is discharged through said inner member directly into the surrounding atmosphere.

10. The apparatus of claim 5 wherein a plurality of spiral vanes are wrapped about the inner section to provide a number of equally spaced spiral-shaped conduits axially extending along said inner section.

11. Apparatus for supporting a conditioning tool within a high temperature furnace including an outer elongated cylinder forming the outer wall of a boom for bringing a conditioning tool into and out of a high temperature furnace, a rear wall mounted in airtight relationship in the rear of said outer cylinder, a tool holder mounted in airtight relationship in the front of said outer cylinder and being arranged to receive a conditioning tool therein, an inner, smaller diameter cylinder mounted in axial alignment within the outer cylinder with the inner cylinder that passes through said rear wall whereby an inner and an outer air passage are established within the boom that extend axially along the boom, means to introduce a stream of cooling air into the rear of the outer passge whereby the air is caused to move to the front of the outer passage and then is exhausted to atmosphere through said inner passage, and a plurality of spiral vanes that are wrapped about the inner cylinder and wherein each vane extends outwardly in a radial direction to substantially span said outer air passage.

12. The apparatus of claim 11 that further includes air chamber means formed in said tool holder which is in fluid flow communication with said outer air passage whereby cooling air is caused to move through said air chamber means.

13. The apparatus of claim 12 that further includes a blower secured to the rear end of said outer cylinder having a discharge that passes into said outer passage at the rear end of said outer cylinder.

* * * * *